United States Patent [19]

Hayatdavoudi et al.

[11] Patent Number: 4,491,414

[45] Date of Patent: Jan. 1, 1985

[54] FLUID MIXING SYSTEM

[75] Inventors: Asadollah Hayatdavoudi; Ronald F. Marascalco, both of Lafayette, La.

[73] Assignee: Petroleum Instrumentation & Technological Services, Lafayette, La.

[21] Appl. No.: 390,954

[22] Filed: Jun. 22, 1982

[51] Int. Cl.[3] ..... B01F 5/10

[52] U.S. Cl. ..... 366/6; 366/34; 366/137; 366/154; 366/159; 366/173

[58] Field of Search ..... 261/77, 79 A; 366/3, 366/6, 10, 30, 33, 34, 134, 136, 137, 154, 159, 173, 174, 176, 177, 191

[56] References Cited

U.S. PATENT DOCUMENTS

| | | | |
|---|---|---|---|
| 626,950 | 6/1899 | Wheelwright . | |
| 2,096,174 | 10/1937 | Hamill . | |
| 2,118,908 | 5/1938 | Vermillion . | |
| 2,523,126 | 9/1950 | Long . | |
| 2,626,779 | 1/1953 | Armentrout . | |
| 2,747,974 | 5/1956 | Felger . | |
| 2,813,702 | 11/1957 | Thomas . | |
| 3,166,020 | 1/1965 | Cook | 366/137 |
| 3,291,456 | 12/1966 | Deane . | |
| 3,946,993 | 3/1976 | Morlin . | |
| 3,953,226 | 4/1976 | Emond et al. . | |
| 3,994,808 | 11/1976 | Kearney . | |
| 4,092,013 | 5/1978 | Staaf . | |
| 4,107,933 | 8/1978 | Lamy . | |
| 4,145,909 | 3/1979 | Daughtry . | |
| 4,170,420 | 10/1979 | Underwood . | |
| 4,184,771 | 1/1980 | Day . | |
| 4,190,373 | 2/1980 | Zucker et al. . | |
| 4,210,613 | 7/1980 | Webb | 261/77 |
| 4,215,081 | 7/1980 | Brooks . | |
| 4,235,552 | 11/1980 | Underwood . | |
| 4,252,445 | 2/1981 | Underwood . | |
| 4,285,601 | 8/1981 | Miner . | |

*Primary Examiner*—Robert W. Jenkins
*Assistant Examiner*—Arthur D. Dahlberg
*Attorney, Agent, or Firm*—Charles C. Garvey, Jr.

[57] ABSTRACT

A fluid agitating apparatus is disposed in a vessel containing a body of fluid to be agitated. The fluid agitating apparatus includes a housing having an inlet at an open lower end thereof, and an outlet at an open upper end thereof, with a flow passage disposed through the housing communicating the inlet and the outlet. The flow passage is preferably circular in cross-section and has a minimum diameter at a throat thereof. The diameter of the flow passage increases continuously from the throat toward both the inlet and the outlet. A vertically upward directed nozzle is located in the flow passage below the throat for inducing flow of fluid from the body of fluid in which the housing is submerged into the inlet and upward through the flow passage. A tangentially directed nozzle is disposed in the flow passage above the throat for inducing a swirling flow in the fluid flowing upward through the flow passage. This creates a swirling vortex type flow exiting the outlet of the housing which provides agitation of the body of fluid in which the apparatus is submerged. Covers are provided in the corners of the vessel to prevent deposition of sediment at those corners. Additional nozzles extend through a wall of the vessel near the bottom thereof for agitating a lower portion of the body of fluid adjacent the bottom of the vessel.

13 Claims, 21 Drawing Figures

FLUID MIXING SYSTEM

BACKGROUND OF THE INVENTION

The present invention relates generally to apparatus and methods for the agitation of fluids, and more particularly, but not by way of limitation, to such a system suitable for the agitation of drilling fluid commonly known as drilling mud which is utilized in the drilling of a well. The well can be of any type and might, for example, be an oil or gas well, a geothermal well, or a leaching well such as is used for leaching uranium.

DESCRIPTION OF THE PRIOR ART

In the drilling of a well, a drilling fluid commonly known as drilling mud is generally utilized in the well bore to maintain a hydrostatic pressure in the well bore sufficient to prevent fluids in intersected subterranean formations from flowing out of those formations into the well bore. The hydrostatic pressure provided by a given column of drilling mud within a well bore depends on the density of the drilling mud. This density is closely controlled and may be varied by adding solid particulate material, generally in the form of barite, to the drilling mud to increase its density when high pressure formations are encountered during the drilling.

The drilling mud is typically circulated down through the central bore of a string of drill pipe, then out orifices in the drill bit, then up through the annulus between the drill pipe and the well bore back to the surface where it proceeds through a sizing system and is then once again pumped down into the well.

This sizing system located at the surface generally consists of a series of tanks and various sizing devices for removing large solid particles from the mud in successively decreasing increments of particle size.

Generally the mud which is returned from the well annulus to the sizing system first is directed to a shaker which removes the largest solid particles, such as chunks of rock which have been drilled from the earthen formation by the drill bit, from the mud. The mud goes from the shaker to a settling pit where the next smaller size of solid materials is allowed to settle from the mud due to the influence of gravity.

The mud then typically goes through a hydrocyclone and then subsequently through a centrifuge to remove even smaller sizes of solid materials. Clean mud from the centrifuge goes into a storage tank from which it is pumped back down into the well. In order to increase the density of the mud, additional barite may be dumped into the mud through a hopper, and typically this new barite is added to the mud in the storage tank immediately upstream from the mud pump.

It is important that the fluid in the tank wherein the new barite is introduced be sufficiently agitated to prevent the barite from settling to the bottom of the tank.

The prior art has typically used mechanical paddle type mixers in the storage tank, or has used a fluid jet disposed through a wall or along the wall of the storage tank near the bottom of the tank, for agitating the fluid in the tank and preventing this deposition of barite sediment in the bottom of the tank.

Although those prior art systems do provide some agitation of the fluid in the tank, they generally do not provide agitation of the entire volume of fluid in the tank and they typically leave dead spots in the volume of the tank wherein sedimentation is allowed to occur.

The present invention provides a system which, through a relatively simple apparatus, provides improved agitation of very large volumes of fluid thus providing a significant improvement over the prior art systems.

SUMMARY OF THE INVENTION

The fluid agitating system of the present invention includes a fluid agitation apparatus. This apparatus includes a housing having an inlet disposed in a first end thereof, an open second end, and a flow passage disposed therethrough communicating said inlet and said open second end. A flow inducing nozzle means is attached to the housing for jetting fluid into the flow passage and thereby inducing flow of fluid from a surrounding body of fluid in which the housing is submerged, into said inlet and through said flow passage and out said open second end of said housing. The flow inducing nozzle means also imparts a swirling flow about a longitudinal axis of said housing to the fluid flowing through the flow passage.

This creates a vortex type flow exiting the open second end of the housing. When the housing is oriented in a preferred vertical orientation, this causes the body of fluid in which the housing is submerged to rotate in substantially vertical planes radiating outward from the perimeter of the housing due to the influence of the vortex flow exiting the upper end of the housing.

A lower portion of the body of fluid, which generally contains the majority of the barite sediment, is drawn into the lower inlet of the housing and is ejected from the upper outlet of the housing thus dispersing the barite throughout the body of fluid in a very much more uniform distribution than is generally provided by any of the prior art systems.

The system also includes a vessel in which the fluid agitating apparatus is disposed. The vessel contains the body of fluid to be agitated. A jet means is operably associated with the vessel, and includes a plurality of nozzles located in the vessel for agitating fluid near the bottom of the vessel. Covers may also be provided in corners of the vessel to prevent deposition of sediment in the corners.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
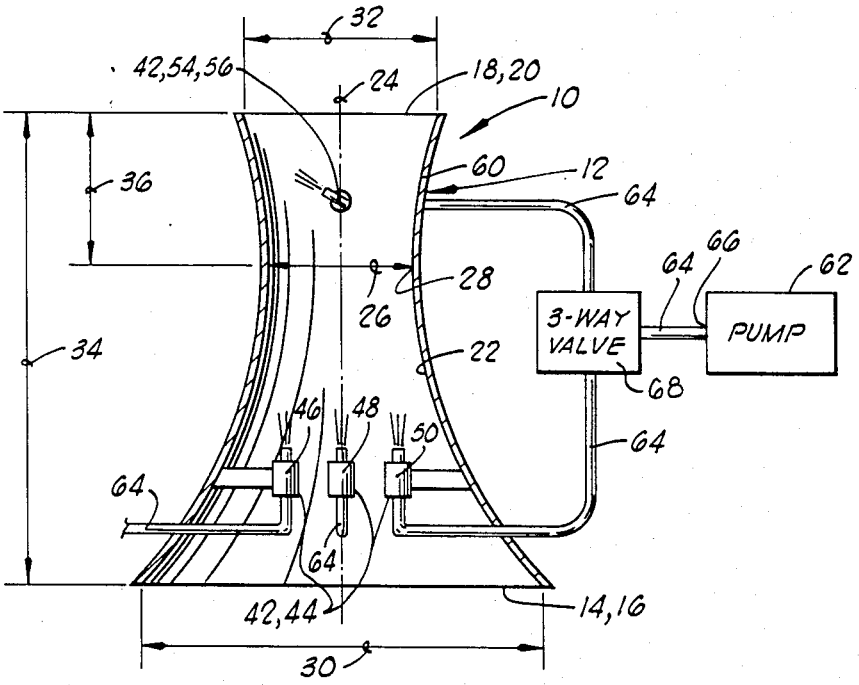
FIG. 1 is a schematic elevation sectioned view of the fluid mixing apparatus of the present invention, connected to a pump and to a valve means for controlling the flow of fluid to the nozzles of the fluid agitating apparatus.

Referring now to the drawings, and particularly to FIG. 1, the fluid agitating apparatus of the present invention is thereshown and generally designated by the numeral 10.

The fluid agitating apparatus 10 includes a housing 12 having an inlet 14 disposed in an open first end 16 thereof and having an outlet 18 disposed in an open second end 20 thereof. A flow passage 22 is disposed through the housing communicating the inlet 14 and the outlet 18.

Figure 2:
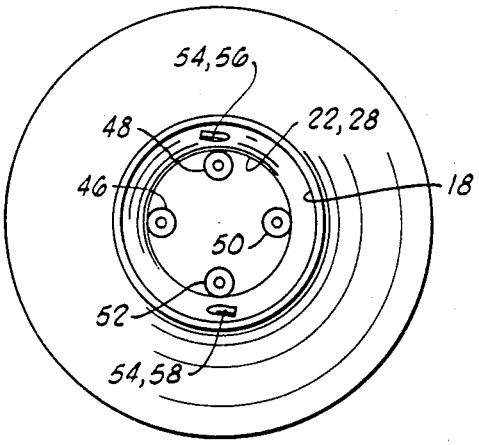
FIG. 2 is a plan view of the apparatus of FIG. 1 showing a preferred embodiment wherein the flow passage of the housing has a circular cross-section.

In a preferred embodiment, as illustrated in FIG. 2, the flow passage 22 has a circular cross-section in a plane normal to a longitudinal axis 24 of the housing 12.

The circular cross-section flow passage 22 has a minimum internal diameter 26 at a throat 28 thereof.

The circular cross-section flow passage 22 continuously increases in internal diameter in a curvilinear fashion from the throat 28 toward each of the inlet 14 and outlet 18.

The circular cross-section flow passage 22 has an internal diameter 30 at inlet 14 and an internal diameter 32 at outlet 18.

A height 34 of housing 12 is defined as a vertical distance between the inlet 14 and the outlet 18. The throat 28 is located a distance 36 below the outlet 18.

Figure 5:
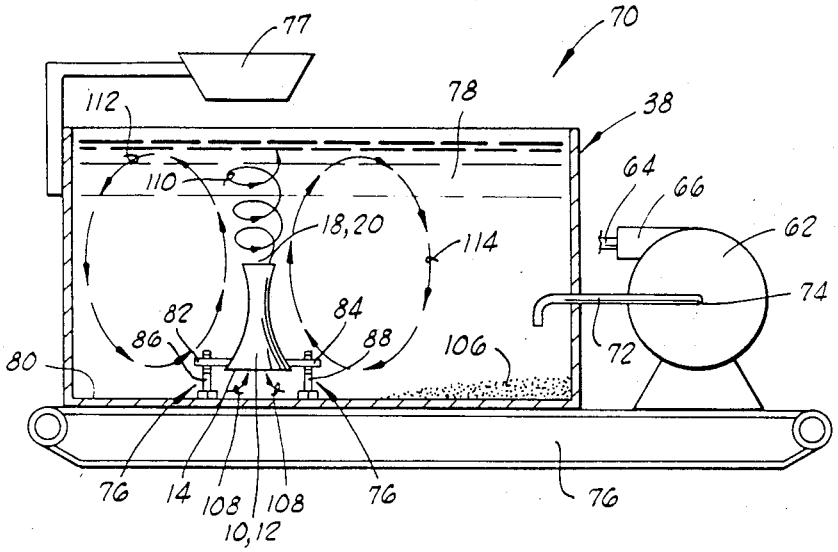
FIG. 5 is a schematic elevation partly sectioned view of the apparatus of FIG. 1 in place within a vessel containing a body of fluid to be agitated, and also illustrating a pump and various conduit means.

A typical size of tank, such as a vessel 38 illustrated in FIG. 5, in which the fluid agitating apparatus 10 would be utilized in a typical oil field environment has dimensions of approximately ten feet wide, ten feet high, and from ten to forty feet long. For use in such a vessel in the agitation of typical drilling muds, the fluid agitating apparatus 10 preferably has approximately the following dimensions.

The height 34 is approximately twenty-four inches. The distance 36 at which the throat 28 is located below the outlet 18 is preferably in the range of about twenty-five to fifty percent of the height 34, and preferably is approximately one-third of the height 34. The inlet 14 has an internal diameter 30 of approximately twenty inches, and the outlet 18 has an internal diameter 32 of approximately ten inches. The ratio of the inlet internal diameter 30 to the outlet internal diameter 32 is preferably in the range of about 2.0 to 2.5. The throat 28 has an internal diameter 26 in the range of about four to six inches or of about forty to sixty percent of the internal diameter 32 of outlet 18.

For these dimensions, it can be seen that the cross-sectional area of the inlet 14 is in the range of about 4.0 to 6.25 times as great as the cross-sectional area of the outlet 18. The cross-sectional area of throat 28 is in the range of about sixteen percent to thirty-six percent of the cross-sectional area of outlet 18.

If the length of vessel 38 is substantially greater than the width thereof, it may be necessary to use two or more of the fluid agitating apparatuses 10.

Although the cross-sectional area of flow passage 22 is preferably circular in shape, it is possible for it to be noncircular, and in certain applications, it may be desirable for it to be noncircular.

Figure 3:
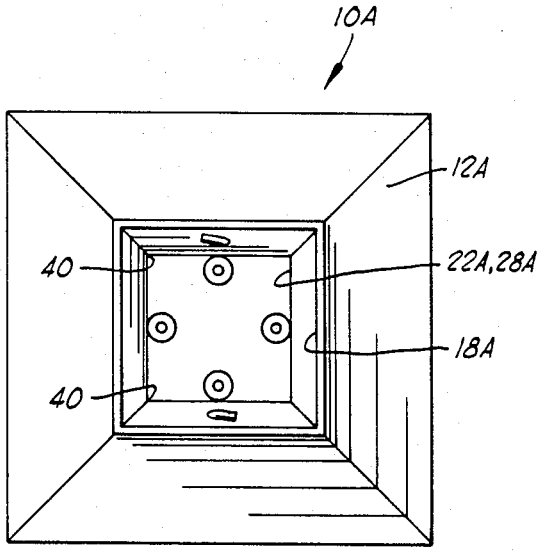
FIG. 3 is a plan view similar to FIG. 2 of the apparatus of FIG. 1, showing an alternative embodiment wherein the flow passage has a square or rectangular cross-section.

For example, an alternative version of the fluid agitating apparatus is illustrated in FIG. 3 and designated by the numeral 10A. FIG. 3 is a plan view similar to FIG. 2 illustrating the appearance of the fluid agitating apparatus 10 of FIG. 1 with that fluid agitating apparatus having a square cross-sectional flow passage 22A.

Figure 4:
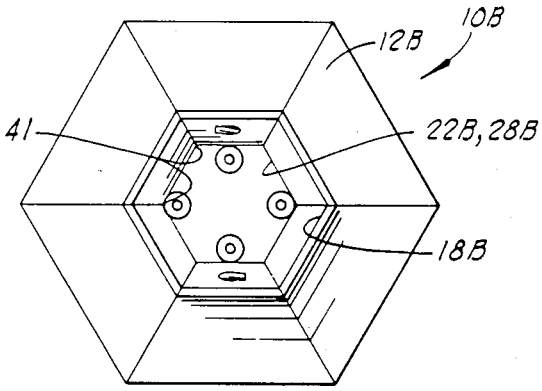
FIG. 4 is a view similar to FIG. 2 showing a plan view of another alternative embodiment of the apparatus of FIG. 1 wherein the flow passage of the apparatus has a hexagonal cross-section.

Similarly, in FIG. 4, another alternative version of the apparatus of FIG. 1 having a hexagonal cross-section flow passage 22B is shown and designated by the numeral 10B.

Analogous components of the apparatus 10A and 10B are illustrated with the same numerals as the apparatus 10 of FIG. 1 with the addition of an "A" or "B" suffix, respectively. The elevation section view of FIG. 1 is still accurate for the alternative embodiments of either FIG. 3 or 4.

The dimensions of the alternative structures of FIGS. 3 and 4 should be such that the ratios of cross-sectional areas of the flow passage 122 at the inlet 14, the throat 28, and the outlet 18 remain substantially the same as the ratios of cross-sectional areas in the example given for the round cross-sectional flow path of FIG. 2.

The use of a noncircular cross-section flow passage such as provided by either the apparatus 10A or 10B of FIGS. 3 and 4, respectively, has some advantages over a circular cross-section in that additional turbulence is induced in fluid swirling upward through the housing because of the effect of corners such as the corners 40 in FIG. 3 and the corners 41 in FIG. 4.

Referring now to FIGS. 1 and 2, a flow inducing nozzle means 42 is attached to the housing 12 for jetting fluid into the flow passage 22 and for thereby inducing flow of fluid from a surrounding body of fluid in which the housing 12 is submerged, into the inlet 14 and through the flow passage 22 and out the outlet 18. The flow inducing nozzle means 42 also imparts a swirling flow to the fluid flowing through the flow passage 22. This swirling flow swirls about the longitudinal axis 24 of housing 12.

The flow inducing nozzle means 42 includes a longitudinal component nozzle means 44 for jetting fluid into the flow passage 22 with a component of flow direction parallel to the longitudinal axis 24 and toward the open second end 20 of housing 12, and for thereby inducing the flow of fluid from the surrounding body of fluid into the inlet 14 and through the flow passage 22 and out the open second end 20 of the housing 12.

The longitudinal component nozzle means 44 is located below the throat 28 and above the inlet 14 and includes a plurality of nozzles 46, 48, 50 and 52 oriented parallel to longitudinal axis 24 and directed toward the open second end 20 of housing 12. Nozzles 46, 48, 50 and 52 are preferably located directly below throat 28 so that they direct jets of fluid vertically upward through throat 28.

The flow inducing nozzle means 42 further includes a tangential component nozzle means 54 for jetting fluid into the flow passage 22 with a component of flow direction perpendicular to the longitudinal axis 24 and tangential to the periphery of flow passage 22 for thereby imparting said swirling flow to the fluid flowing through the flow passage 22.

The tangential component nozzle means 54 is located above throat 28 and below outlet 18. Tangential component nozzle means 54 preferably includes at least two nozzles such as 56 and 58, each of which extends through a wall 60 of housing 12.

The ratio of the distance 36 to the height 34 has an important effect on the effectiveness of the tangential component nozzle means 54. If the throat 28 is too close to the upper end 20 of housing 12, the swirling flow of fluid from nozzles 56 and 58 will not interact sufficiently with the vertical jets of fluid from longitudinal nozzles 46, 48, 60 and 52. Those vertical jets will merely be ejected straight upward out of outlet 18 if distance 36 is too short. By making distance 36 approximately one-third the value of height 34, the vortex action within housing 12 above throat 28 will deflect the jets of fluid from nozzles 46, 48, 60 and 52 radially outward so that they will tend to be mixed with the swirling fluid.

Also, the tangential nozzles 56 and 58 should be constructed to be as nearly exactly tangential as possible to the outer perimeter of the flow passage 22 at the area where the nozzles 56 and 58 extend through housing 12 into the flow passage 22. If they are not substantially tangential, the jets of fluid ejected therefrom will tend to shoot directly through the outlet 18 thus minimizing their contribution to the swirling flow within housing 12.

A pump 62 provides a source of fluid under pressure. A discharge conduit 64 connects a discharge outlet 66 of pump 62 to both the longitudinal component nozzle means 44 and the tangential component nozzle means 54.

A three-way valve means 68 is disposed in discharge conduit 64 for proportionally controlling a flow rate of fluid to the longitudinal component nozzle means 44 relative to a flow rate of fluid to the tangential component nozzle means 54.

FIG. 5 illustrates a fluid mixing system 70. The system 70 includes the fluid agitating apparatus 10 in place within the rectangular parallelepiped shaped vessel 38. The system 70 also includes the pump 62. A suction conduit 72 is connected between the vessel 38 and a suction inlet 74 of the pump 62.

The discharge outlet 66 of pump 62 has the discharge conduit 64, which may also be referred to as a power fluid conduit 64, attached thereto. The entirety of the discharge conduit 64 is not illustrated in FIG. 5, but it is understood that the discharge conduit 64 is connected to the apparatus 10 in a manner such as that illustrated schematically in FIG. 1. The discharge conduit 64 will typically be a flexible conduit which will extend over the walls of the vessel 38 and downward into the vessel 38 where it is connected to the fluid agitating apparatus 10.

The system 70 further includes a skid frame 76 which has the vessel 38 and the pump 62 mounted thereon. Generally, the pump means 62 will includes a prime mover (not shown) such as a diesel engine or an electric engine for driving the pump.

Also, a hopper 77 is preferably located directly above fluid agitating apparatus 10, so that additional barite may be dumped directly into the most turbulent portion of a body of fluid 78 contained in vessel 38. The hopper 77 also may be arranged to feed dry barite into discharge line 64 from pump 62.

The fluid mixing system 70 illustrated in FIG. 5 is a preferred self-contained version of the system. It is not, however, necessary that all of the components of this system be mounted on a single frame such as the skid frame 76. It is possible to utilize the fluid agitating apparatus 10 in an existing mixing tank of a typical prior art oil field mud filtering system such as described above in the summary of the prior art, and to utilize the same with a conventional mud pump or with any pumping device suitable for circulating mud through the mixing tank. In order to provide sufficient pressure for the operation of the fluid mixing apparatus 10, it is generally desirable that the pump 62 provide a pressure in discharge conduit 64 of at least 30 psig.

The fluid agitating apparatus 10 illustrated in FIG. 5 is shown having a positioning means 76 operatively associated with the housing 12 for positioning the housing 12 vertically in the body of fluid 78 contained in the vessel 38 with the inlet 14 of the housing 12 located above a bottom 80 of vessel 38, and with the open second end 20 of housing 12 submerged in the body of fluid 78.

The positioning means 76 includes three or more radially outward extending arms such as 82 and 84 which have threaded vertical structural supports 86 and 88 extending downward therefrom and engaging the bottom 80 of vessel 38.

Due to the threaded engagement of supports 86 and 88 with the arms 82 and 84, the length of the supports 86 and 88 is adjustable so that the distance between the inlet 14 and the bottom 80 of vessel 38 may be varied.

The positioning means 76 illustrated in FIG. 5 rests freely on the bottom of vessel 80, although it will be apparent that if desired, the positioning means 76 could be fixedly attached to the bottom 80.

Figure 6:
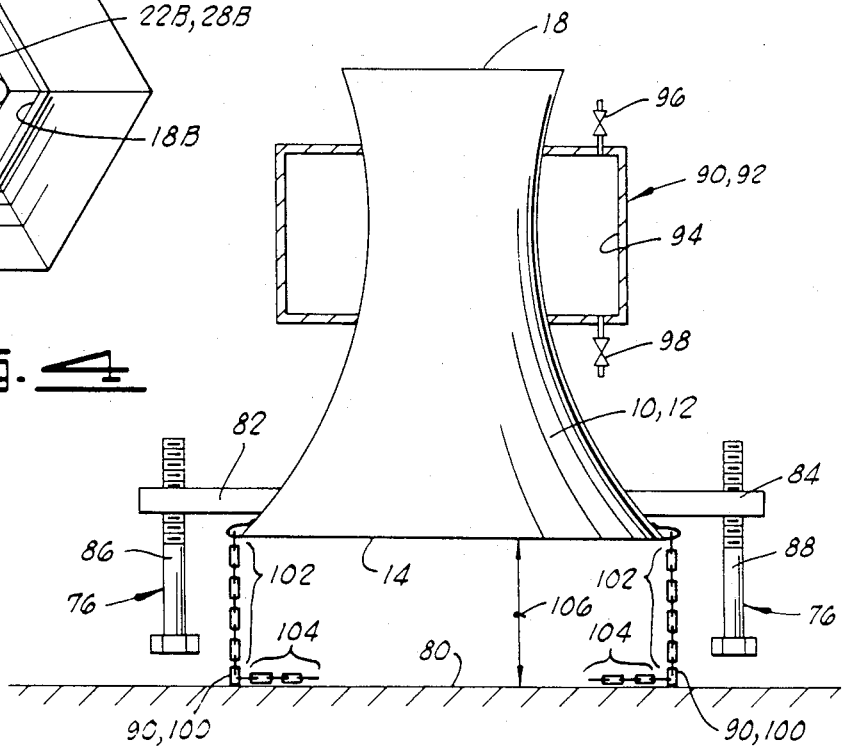
FIG. 6 is a schematic partially sectioned elevation view of the apparatus of FIG. 1 illustrating one version of a positioning means for use in combination with said apparatus to position the lower end of the fluid agitating apparatus above a bottom of a vessel.

FIG. 6 shows the fluid agitating apparatus 10 having a modified positioning means. In FIG. 6, the positioning means includes several components which as combined are indicated as the positioning means 90.

The positioning means 90 includes a flotation means 92 attached to the housing 12 for giving the housing 12 a positive buoyancy.

As illustrated in section in FIG. 6, the flotation means 92 is preferably an annular shaped member having a hollow annular cavity 94 which may be empty to provide a maximum buoyancy or which may be partially filled with fluid by means of ballast valves 96 and 98 to decrease the buoyancy thereof.

A weight means 100, of positioning means 90, hangs downward from the housing 12 and engages the bottom 80 of vessel 38 for holding the housing 12 submerged within the body of fluid 78.

The weight means 100 is preferably a flexible extended length weight means, such as a link chain, having a mass thereof distributed along the length thereof. Thus, a first portion 102 of weight means 100 which has a weight equal to the buoyancy of the housing 12 due to the flotation means 90, is supported by the housing 12. A second portion 104 of weight means 100 rests on the bottom 80 of the vessel 38.

Thus, the distance 106 between the inlet 14 of housing 12 and the bottom 80 of vessel 38 may be varied by varying the buoyancy of flotation means 92.

In the embodiment of FIG. 6, the arms 82 and 84, and the downward extending structural supports 86 and 88, are utilized to limit downward movement of the housing 12 relative to the bottom 80 of vessel 38, so as to determine a minimum value of the distance 106. This is necessary, because forces imposed upon the fluid agitating apparatus 10, such as from the jet action of the nozzle means 44 and 54, will tend to move the apparatus 10 within the vessel 38.

In that regard, it is noted that the jet action of the tangential component nozzle means 54 will impose a force on the housing 12 tending to cause the housing 12 to rotate about its vertical longitudinal axis 24. That rotational motion will generally be opposed by some form of mechanical anchoring of the apparatus 10, which may in fact be provided by the connection of the apparatus 10 to the discharge conduit 64 or to some other portion of the fluid mixing system 70 as may be appropriate in the particular application involved.

Although the fluid mixing apparatus 10 is illustrated in the figures in a vertical orientation, it is noted that the apparatus 10 will function to agitate fluid within the vessel 38 regardless of the orientation of the longitudinal axis 24 of the apparatus 10. In fact, it has been determined that the apparatus 10 may be inverted so that the longitudinal axis 24 is still vertical but so that the inlet 14 is at the top and the outlet 18 is at the bottom of the housing 12. The flow pattern of fluid relative to the housing 12 and its inlet and outlet is still generally the same, although the effect of that flow pattern upon distribution of sediment within the vessel is generally most favorable with the housing 12 oriented as illustrated in the figures.

Referring again to FIG. 5, the flow pattern of the body of fluid 78 within the vessel 38 relative to the fluid agitating apparatus 10 is there schematically illustrated.

A lower portion of the body of fluid 78, which contains the greatest amount of sediment such as indicated at 106, flows along the bottom 80 of vessel 38 toward the inlet 14 and then upward into the inlet 14 as indicated by the arrows 108. This upward motion of fluid is induced by the longitudinal component nozzle means 44.

The tangential component nozzle means 54 induces a swirling motion in this upward flowing fluid flowing through the flow passage 22, so that this fluid exits the outlet 18 in an upward spiralling path creating a vortex type flow as indicated by the spiralled arrows 110.

This upward spiralling vortex type flow exiting the outlet 18 of fluid agitating apparatus 10 induces adjacent fluid in the body of fluid 78 to rotate in substantially vertical planes such as indicated by the arrows 112 and 114 on either side of the fluid agitating apparatus 10. It will be understood that this rotational flow pattern will be present in any vertical plane extending radially outward from the fluid agitating apparatus 10.

Thus, a relatively large volume of the fluid within the vessel 38 is agitated by the fluid agitating apparatus 10. The portion of that fluid adjacent the bottom 80 of the vessel 38, which contains the majority of the sediment 106, is sucked up into the inlet 14 where, due to the spiralling flow in the apparatus 10, it is very thoroughly mixed with incoming clean fluid directed to the flow inducing nozzle means 42 and with fluid in the upper portions of body of fluid 78 as it exits the outlet 18 and flows through the spiralling pattern indicated by the arrows 110. Additionally, the rotational flow indicated by the arrows 112 and 114 further tends to circulate the entire body of fluid 78 and to keep solid particles contained in the fluid from settling out on the bottom 80.

For a fluid mixing apparatus 10 having dimensions 26, 30, 32, 34 and 36 as set forth in the example given above for a typical oil field installation of the apparatus 10, the nozzles 46, 48, 50, 52, 56 and 58 should have an orifice diameter in the range of about three-quarter inch to two inches diameter. It is necessary that this diameter be sufficiently large that it cannot be plugged by loss circulation material which might be utilized in the drilling fluid, and thus the nozzle orifice diameter should be something in excess of one-half inch which is typically the largest diameter of loss circulation material which is normally used.

The nozzles are preferably sized so as to maximize the kinetic energy of the fluid which can be pumped through the nozzles with available pumping sources. Increasing the nozzle orifice diameter tends to increase the mass flow rate of fluid being ejected from the nozzles, but tends to decrease the velocity of the fluid. The kinetic energy, which is equal to one-half the mass times the velocity squared, should be maximized to the extent practical.

Although an optimum ratio has not as yet been determined, it is presently believed that satisfactory operation of the fluid agitating apparatus 10 is provided if the total flow of fluid under pressure from pump 62 to the longitudinal component nozzle means 44 and the tangential component nozzle means 54 is divided in a ratio such that approximately twenty-five percent of the total flow is directed to the tangential component nozzle means 54 and approximately seventy-five percent of the total flow is directed to the longitudinal component nozzle means 44. This proportional relationship is accomplished by adjustment of the three-way valve 68 illustrated in FIG. 1.

Figure 7:
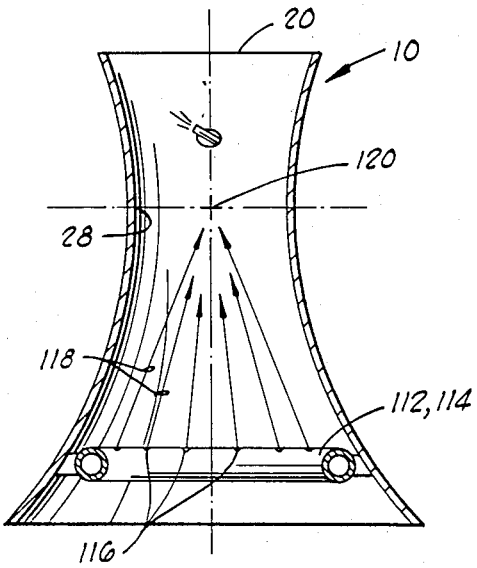
FIG. 7 is a schematic sectioned elevation view of an alternative version of the apparatus of FIG. 1 illustrating an alternative form of a longitudinal component nozzle means having a plurality of upward directed nozzles directed toward an apex.

FIG. 7 is an elevation sectioned illustration of a modified version of the fluid agitating apparatus 10 which illustrates an alternative version of the longitudinal component nozzle means, which is designated in FIG. 7 by the numeral 112. The longitudinal component nozzle means 112 includes a circular manifold 114, shown in section in FIG. 7, which has a plurality of nozzle orifices 116 disposed therein. The nozzle orifices 116 are directed longitudinally upward toward the open second end 20 and are directed radially inward so that the jets of fluid ejected from the nozzle orifices 116 are directed as indicated by the arrows 118 toward an imaginary apex 120 which preferably coincides with the location of throat 28.

Figure 8:
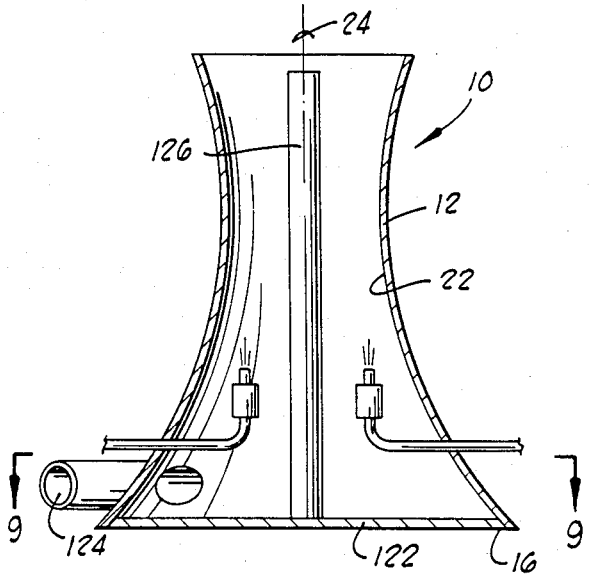
FIG. 8 is a schematic elevation view of an alternative version of the apparatus of FIG. 1 having a closed bottom end with tangential inlets adjacent said bottom end, and also illustrating the use of a vortex finder disposed along the central vertical axis of the housing.

Referring now to FIG. 8, an elevation sectioned view is thereshown of a modified version of the fluid agitating apparatus 10 wherein the first end 16 is closed by a wall 122, and an inlet 124 is provided in a horizontal plane adjacent the first end 16.

The apparatus 10 of FIG. 8 also illustrates the use of a vortex finder 126 which is disposed axially along the longitudinal axis 24 of housing 12. The vortex finder 126 is attached to the end wall 122 and extends upward therefrom. It will be understood, however, that a vortex finder such as 126 may be utilized with a version of the fluid agitating apparatus 10 such as illustrated in FIG. 1 having an open lower first end 16 by merely supporting the vortex finder 126 by spider-like struts (not shown) extending radially outward therefrom and attached to the housing 12.

Figure 9:
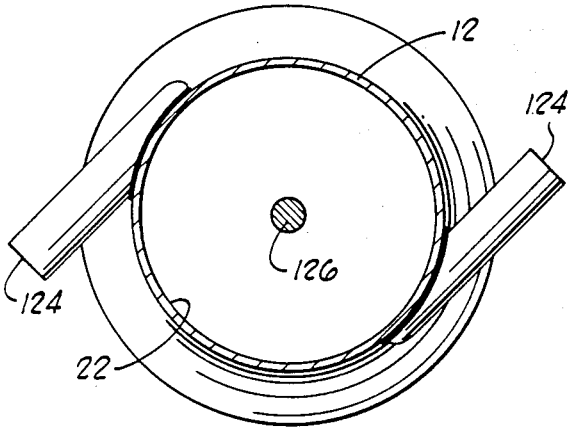
FIG. 9 is a plan sectioned view along line 9—9 of FIG. 8 illustrating the tangential inlet orientation.

As shown in FIG. 9, the inlets 124 are preferably oriented so that fluid flowing into the flow passage 22 enters tangentially thereto.

Figure 10:
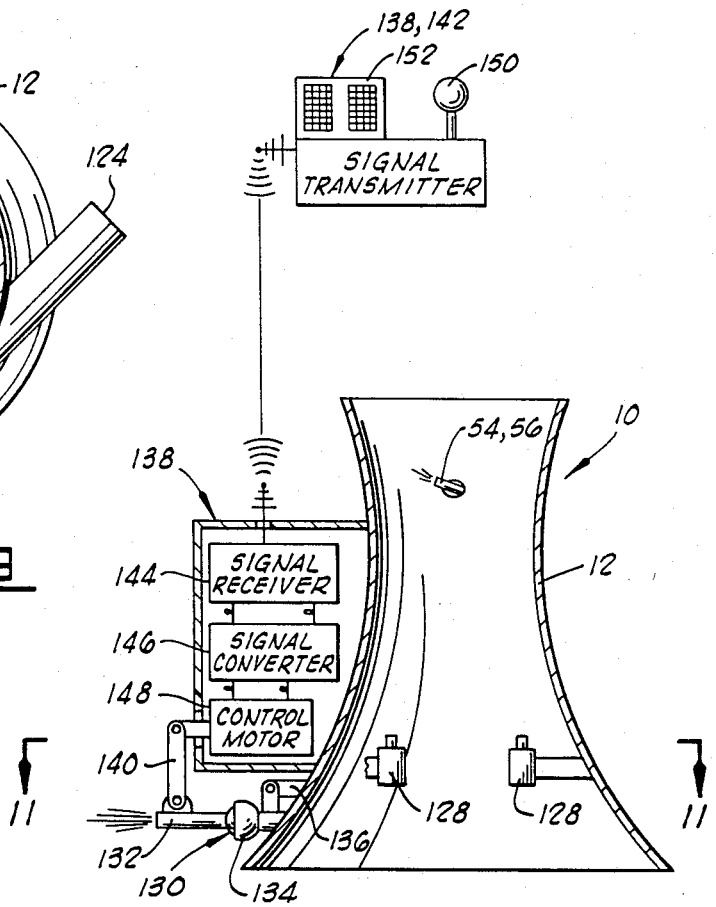
FIG. 10 is a schematic elevation sectioned view of an alternative version of the apparatus of FIG. 1 illustrating the use of external radially outward directed nozzles which may function both as a moving means for moving the fluid agitation apparatus transversely within a vessel, and as a means for increasing the agitation of fluid near the bottom of the vessel.

Referring now to FIG. 10, a schematic sectioned elevation view is thereshown of a fluid agitating apparatus 10 having a somewhat modified longitudinal component nozzle means, designated in FIG. 10 by the numeral 128, and also including a moving means 130 for moving the housing 12 transversely within a vessel like the vessel 38 of FIG. 5.

In the embodiment of FIG. 10, the moving means includes a radially outward directed nozzle 132 attached to the housing 12 for ejecting a jet of fluid with a horizontal component of velocity away from the housing 12 and for thereby moving the housing 12 transversely.

The nozzle 132 illustrated in FIG. 10 is rotatably mounted by a ball and socket type connection 134 to a supply manifold 136, so that the nozzle 132 may be rotated about both vertical and horizontal axes.

Schematically illustrated in FIG. 10 and designated by the numeral 138 is a control means which is schematically illustrated as being connected to the nozzle 132 by a linkage 140, for varying an orientation of the nozzle 132 relative to the housing 12.

The control means 138 is schematically illustrated as being a remote control means. It includes a signal transmitter 142, a signal receiver 144, a signal converter 146, and a control motor 148 connected to the linkage 140. Although the illustrated control means is based upon electrical circuitry, an equivalent system based upon fluidic control circuitry can be used.

The signal transmitter 142 and signal receiver 144 may be of numerous conventional types. They may, for example, use radio signals or they may use sonar signals. Furthermore, a tethered remote control system can be used wherein the transmitter 142 and receiver 144 are connected by an electrical cable, or in the case of a fluidic system by a flexible fluid conduit.

The signal transmitter 142 is schematically illustrated as having both a manually controllable input such as the joy stick type control 150 which a human operator may operate in response to visual observation of the position of the fluid agitating apparatus 10 within a vessel 38 to direct the movement of the fluid agitating apparatus 10 within the vessel 38.

The signal transmitter 142 also includes a program input terminal 152 by means of which preprogrammed signals may be stored and transmitted so as to cause the fluid agitating apparatus 10 to traverse a predetermined path through the body of fluid 78 in the vessel 38. This program control means may also be programmed to send random signals to the receiver 144 to thus cause the fluid agitating apparatus 10 to traverse a random path through the body of fluid 78.

Figure 11:
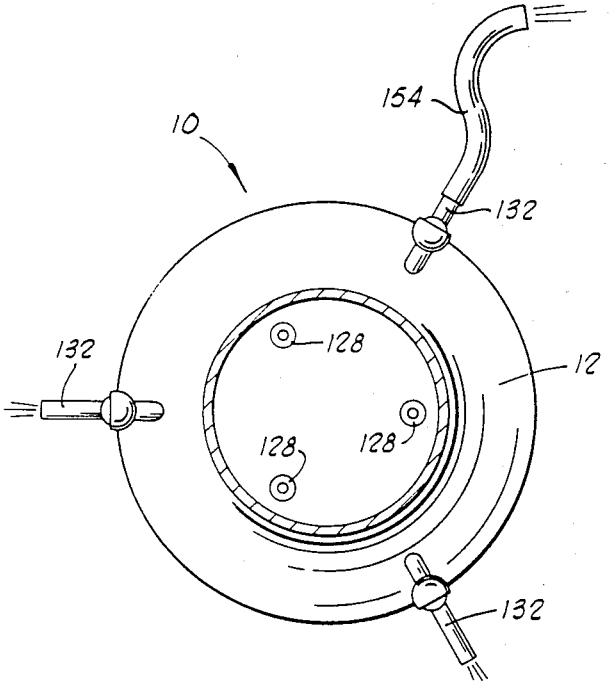
FIG. 11 is a plan sectioned view along line 11—11 of FIG. 10.

FIG. 11 is a plan sectioned view along line 11—11 of FIG. 10 and there illustrates a preferred embodiment of the fluid agitating apparatus 10 when radially outward directed nozzles such as 132 are utilized. FIG. 11 is a schematic illustration and all of the apparatus illustrated in FIG. 10 as being attached to the nozzle 132 has been eliminated for ease of illustration. The important features illustrated in FIG. 11 are the angular orientations of three radially outward directed nozzles 132 at angles of 120° about the periphery of the housing 12, and the orientation of three vertically upward directed nozzles of longitudinal component nozzle means 128 which are also located at angles of 120° apart but which are staggered at angles of 60° from the nozzles 132.

As will be apparent in FIG. 11, the transverse force exerted on the housing 12 from the nozzles 132 will depend on the combined effect of all three of the nozzles. If the nozzles 132 are to be utilized only as a means for providing transverse movement of the housing 12, only one such nozzle is necessary.

In FIG. 11, however, three such nozzles have been illustrated, because the radially outward directed nozzles 132 also function as an agitation nozzle means for ejecting a jet of fluid with a horizontal component of velocity away from the housing to agitate sediment such as 106 seen in FIG. 5, on the bottom 80 of the vessel 38. When the nozzles 132 are provided for this agitating function, it is desirable that a plurality of such nozzles be located around the perimeter of the housing 12 such as illustrated in FIG. 11. Also, further agitation may be provided by attaching a flexible snake conduit such as 154 to those nozzles 132 which are to be utilized for the agitating function. A flexible snake conduit 154 randomly whips about and directs the jet of fluid therefrom in randomly varying directions.

Figure 20:
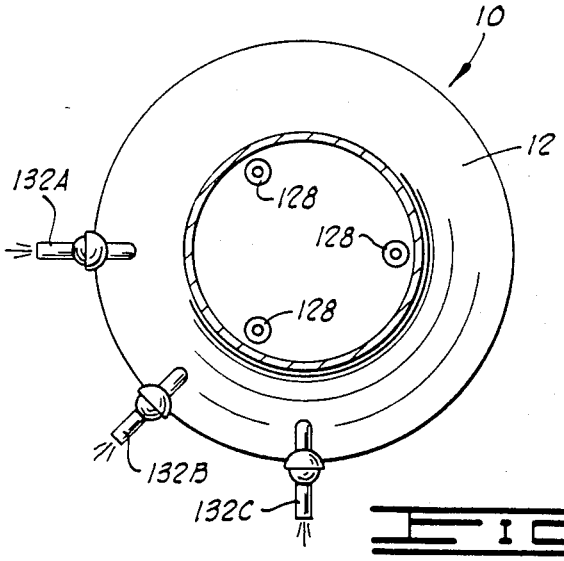
FIG. 20 is a view similar to FIG. 11, showing an alternative arrangement of the radially outward directed nozzles of the apparatus of FIG. 10.

FIG. 20 is a plan section view similar to FIG. 11, showing an alternative arrangement of the radially outward directed nozzles 132A, B and C wherein there are three nozzles 132A, B and C located at angles of 45° apart. This arrangement is preferable when the nozzles 132A, B and C are to be used to provide horizontal locomotion of the apparatus 10. Preferably the apparatus 10 is arranged within a vessel 38 such that the outermost nozzles 132A and 132C are directed at two of the four horizontal corners of a rectangular vessel 38.

Figure 12:
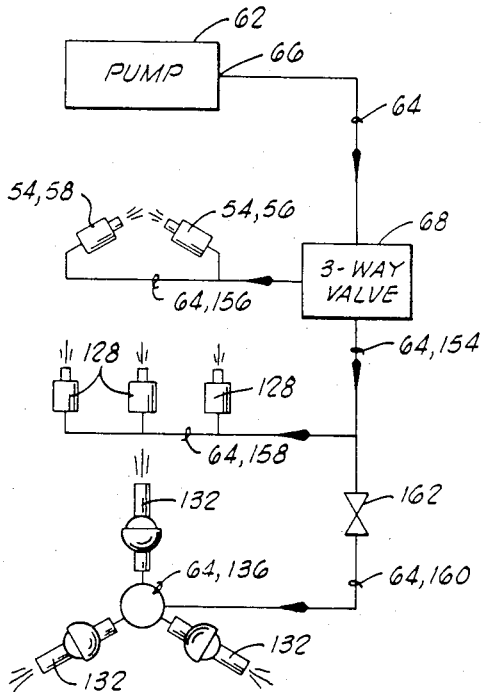
FIG. 12 is a schematic illustration of the manifolding arrangement for directing fluid from the pump to the various nozzles of the apparatus of FIG. 10.

FIG. 12 schematically illustrates a preferred arrangement of the fluid conduits connecting the discharge outlet 66 of pump 62 to the various nozzles. The discharge conduit 64 is connected to both the tangential component nozzle means 54 and the longitudinal component nozzle means 128. It is also connected to the radially outward directed nozzles 132.

The three-way valve 68 previously described, is disposed in the discharge conduit 64 for proportionally controlling the amount of discharge fluid directed to the tangential nozzles 54 and the longitudinal nozzles 128. The three-way valve 68 splits the stream of discharge fluid from pump 62 into a first portion directed through conduit portion 154 to the longitudinal component nozzle means 128 and to the radially outward directed nozzles 132, and a second portion directed through the conduit portion 156 to the tangential component nozzle means 54.

The first portion of the discharge fluid directed through conduit portion 154 is again split into two streams, one of which flows through conduit portion 158 to the longitudinal component nozzle means 128 and the other which flows through conduit portion 160 to the circular manifold 136 which directs the fluid to the radially outward directed nozzles 132. The flow of fluid to the radially outward directed nozzles 132 may be turned on or off by means of a valve 162. The valve 162 could itself be a proportional type valve which would allow some fluid to flow to both the longitudinal component nozzle means 128 and to the radially outward directed nozzles 132.

Also, the nozzles 132 may be directed downward for the purpose of offsetting the reaction forces on housing 12 from upwardly directed nozzles 128, so as to stabilize the vertical position of housing 12 within a body of fluid.

Figure 13:
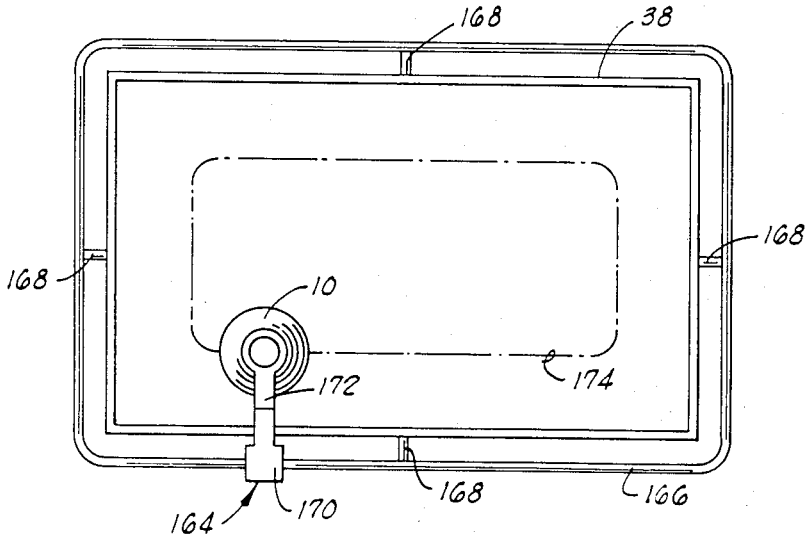
FIG. 13 is a plan schematic illustration of the fluid agitating apparatus of FIG. 1 in place within a rectangular vessel and having a mechanical system attached to the vessel and to the fluid agitating apparatus for moving the fluid agitating apparatus within the vessel along a predetermined path.

Referring now to FIG. 13, a plan schematic view is thereshown of the vessel 38 having a fluid agitating apparatus 10 located therein. An alternative version of moving means is shown and generally designated by the numeral 164, for moving the fluid agitating apparatus 10 transversely within the vessel 38.

The moving means 164 is a mechanical conveyor means attached to the vessel 38 for moving the fluid agitating apparatus 10 relative to the vessel 38.

The mechanical conveyor means 164 includes a rail or track schematically illustrated as 166 which is structurally supported from vessel 38 such as indicated by structural supports 168.

A motorized carrier 170 travels along the rail 166, and has an arm 172 extending into the interior of the vessel 38 and having the fluid agitating apparatus 10 supported therefrom. As the carrier 170 travels around the rail 166 about the perimeter of vessel 38, the fluid agitating apparatus 10 is carried through a path indicated in phantom lines as 174. The path 174 is preferably such that the entire volume of fluid contained within the vessel 38 is agitated by the fluid agitating apparatus 10 as the fluid agitating apparatus 10 makes a single lap around the path 174.

Figure 14:
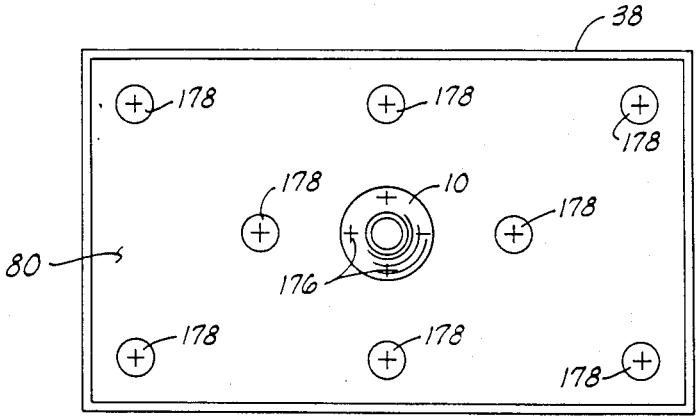
FIG. 14 is a plan schematic illustration of the fluid agitating apparatus of FIG. 1 in place within a vessel, wherein a system of magnets of like sign attached to both the fluid agitating apparatus and to the bottom of the vessel is utilized to move the fluid agitating apparatus to those portions of the vessel having the greatest deposition of sediment on the bottom thereof.

FIG. 14 is a schematic plan view of the vessel 38 having a fluid agitating apparatus 10 disposed therein, and including yet another form of moving means. The moving means in FIG. 14 includes a first magnet schematically represented by the plus signs 176 indicated on fluid agitating apparatus 10, which is thus indicated as being a magnet having a positive magnetic sign.

A plurality of additional magnets 178 all having the same magnetic sign as the first magnet 176, i.e., in the example shown having a positive magnetic sign, are fixed relative to the bottom 80 of the vessel 38 at dispersed positions across the bottom 80 of the vessel 38.

This system of magnets 176 and 178 provides a moving means for moving the fluid agitating apparatus 10 transversely within the vessel 38 and for moving the fluid agitating apparatus 10 toward the locations on the bottom 80 of vessel 38 having the greatest deposit of sediment thereon. This is accomplished in the following manner.

Magnets having like magnetic signs repel each other, so that if there were no sediment on the bottom 80 of vessel 38, the fluid agitating apparatus 10 would tend to orient itself in a position like that illustrated in FIG. 14 substantially equidistant from the various magnets 178.

As any one of the magnets 178 begins to be covered up with sediment such as barite, the magnetic field from that particular magnet will be weakened relative to the magnetic fields of the other magnets, such that the other magnetic fields now being stronger will tend to repel the fluid agitating apparatus 10 and push it toward that one of the magnets 178 which is covered with barite. The fluid agitating apparatus 10 will then agitate that deposit of sediment so as to uncover the particular magnet 178 which was previously covered and thus once again the fluid agitating apparatus 10 will be repelled from that location. In this manner, the fluid agitating apparatus 10 will move about within the tank 38 towards those locations in the tank 38 which have the greatest deposits of sediment on the bottom of the tank.

Figure 15:
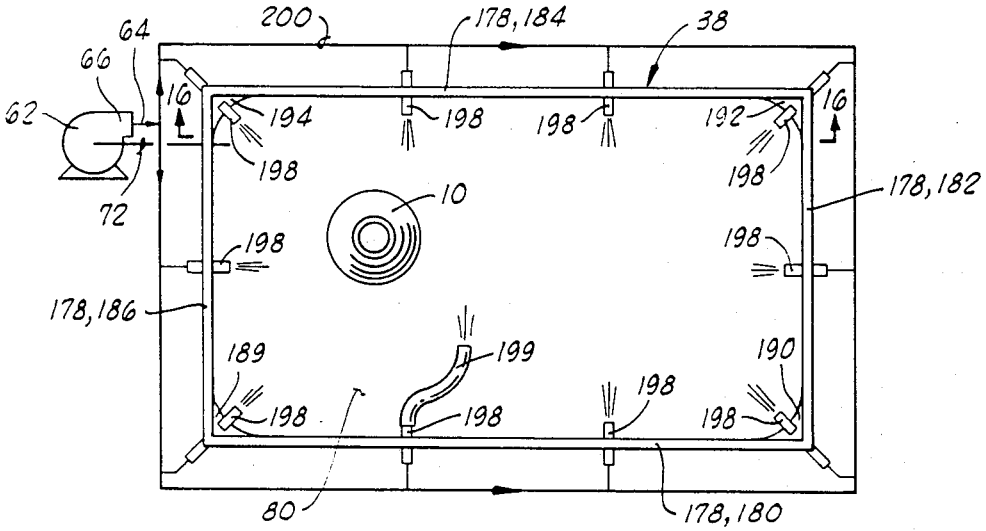
FIG. 15 is a plan schematic illustration of the fluid agitating apparatus of FIG. 1 in place within a rectangular parallel-piped shaped vessel having corner cover means disposed in the corners thereof for preventing deposition of sediment in the corners, and having a plurality of nozzles extending through the wall of the vessel near the bottom thereof for inducing flow of fluid near the bottom of the vessel away from the walls thereof and toward the fluid agitating apparatus.

Referring now to FIG. 15, a schematic plan view is thereshown of a modified version of the vessel 38 having the fluid agitating apparatus 10 disposed therein.

The rectangular parallelepiped shaped vessel 38 may generally be described as having a vertical wall portion 178 comprised of four substantially vertical rectangular flat wall sections 180, 182, 184 and 186 which adjoin each other. The wall portion 178 extends upward from the substantially horizontal rectangular bottom portion 80.

Figure 16:
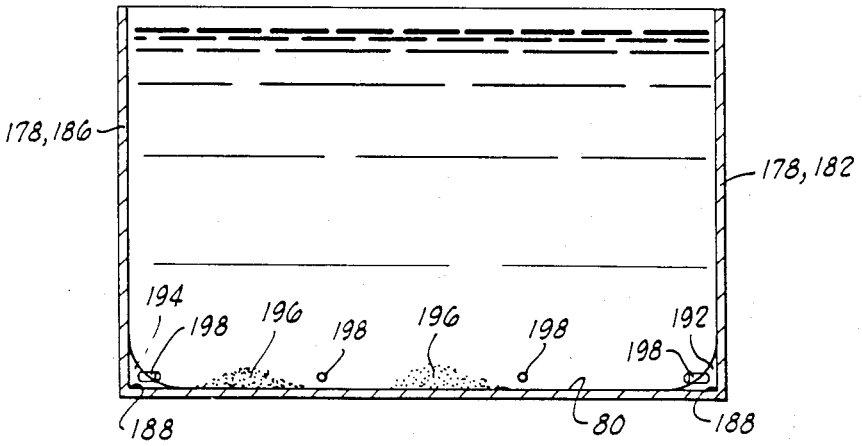
FIG. 16 is a sectioned elevation view along line 16—16 of FIG. 15.

Referring to FIG. 16, which is a sectioned elevation view along line 16—16 of FIG. 15, it is seen that a vertical corner 188 is defined in a vertical plane at the intersection of the wall portion 178 with the bottom 80. This vertical corner 188 extends around the entire perimeter of rectangular bottom portion 80.

Referring again to FIG. 15, there are four corner cover means 189, 190, 192 and 194 located at each intersection of two adjoining wall sections and the bottom section 80 for preventing deposition of sediment such as 196 at said intersections of any two adjoining wall sections and the bottom 80.

The function of these corner cover means 189, 190, 192, 194 may be appreciated when it is noted that dead spots tend to occur in the vessel 38 at the intersection of the various planar surfaces, so by smoothing out that intersection the shape of the vessel is changed to eliminate these dead spots. The corner covers 189, 190, 192 and 194 are preferably compound curved shapes intersecting the planes of the two adjoining wall sections and the bottom 80 so as to provide a rounded corner at the intersection of those three planes.

Further, dead spots tend to be present around the entire perimeter of the vertical corner 188. To minimize deposition of sediment in the vertical corner 188, a jet means 198 is provided for inducing fluid flow adjacent the vertical corner 188 and for thereby reducing deposition of sediment adjacent the vertical corner 188. The jet means 198 preferably includes a plurality of nozzles 198 which extend through the wall portion 178 of vessel 38 into the vessel 38 adjacent the vertical corner 188 and are directed away from the wall portion 178 so that sediment will be moved away from the wall portion 178 towards the center of the vessel 38 where it will be sucked up and mixed by the fluid agitating apparatus 10.

The nozzles 198 may themselves be directed at an angle upward and nonperpendicular to wall portion 178, so that a swirling flow is induced in the entire body of fluid in vessel 38. Flexible snake conduits such as 199 may be attached to any or all of the nozzles 198.

Fluid is directed to the nozzles 198 by a fluid manifold 200 which is connected to the discharge conduit 64 of pump 62. It will be understood that the fluid agitating apparatus 10 is also connected to the discharge conduit 64 in a manner such as that previously described, and that by means of appropriate valving, the amount of flow to the nozzles 198 and to the flow inducing nozzle means 42 of fluid agitating apparatus 10 can be controlled.

Figure 17:
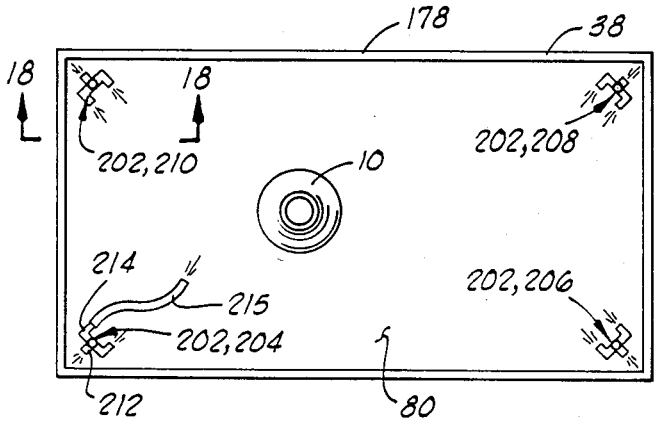
FIG. 17 is a plan schematic view of the fluid agitating apparatus of FIG. 10 in place within a rectangular parallelepiped shaped vessel having a jet means located in each corner of the vessel, which jet means includes nozzles directed both toward and away from a wall of the vessel.

Referring now to FIG. 17, a schematic plan view is thereshown of the vessel 38 having the fluid agitating apparatus 10 disposed therein.

An alternative form of jet means is shown in FIG. 17 and is designated by the numeral 202.

The jet means 202 includes four nozzle manifolds 204, 206, 208 and 210, one of which is located adjacent each of the horizontal corners of bottom 80 of vessel 38.

Each of the nozzle manifolds 204, 206, 208 and 210 are similarly constructed and the nozzle manifold 210 will be described in detail for purposes of illustration.

The nozzle manifold 210 includes at least one nozzle 212 directed toward the wall portion 178 of vessel 38, and includes at least one additional nozzle 214 directed away from the wall portion 178. Flexible snake conduits such as 215 may be placed on any or all of the nozzles 212 and 214.

Figure 18:
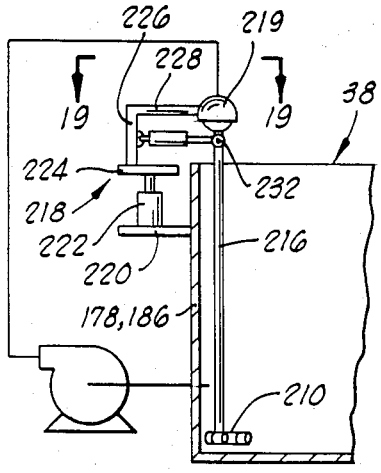
FIG. 18 is a schematic elevation sectioned view along line 18—18 of FIG. 17.

Referring now to FIG. 18 which is a schematic elevation partial view of the apparatus of FIG. 17 taken along line 18—18 of FIG. 17, the nozzle manifold 210 has a vertical conduit 216 extending upward therefrom to a ball and socket type connection 219 which allows the vertical conduit 216 and the attached nozzle manifold 210 to rotate in orientation about both a vertical and a horizontal axis.

Figure 19:
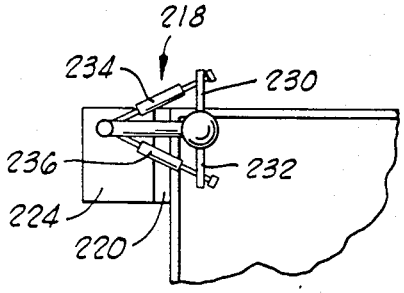
FIG. 19 is a plan schematic view along line 19—19 of FIG. 18.

In FIGS. 18 and 19, a mechanical control system 218 is schematically illustrated for controlling the position of nozzle manifold 210.

A structural support plate 220 extends horizontally outward from fourth wall section 186 of wall portion 178 of vessel 38. A vertically oriented hydraulic ram 222 has its lower end attached to plate 220 and its upper end attached to a movable support plate 224.

A vertical support column 226 extends upward from movable plate 224 and has a horizontal support beam 228 extending horizontally from its upper end towards the vessel 38. The end of horizontal support beam 228 closest to vessel 38 is structurally attached to the upper portion of the ball and socket connection 219.

As is best seen in FIG. 19, two operating arms 230 and 232 extend horizontally from the vertical conduit 216. First and second horizontally oriented rams 234 and 236 are connected between the vertical support column 226 and the outer ends of operating arms 230 and 232.

The vertical ram 222 may be extended and retracted to raise and lower the nozzle manifold 210 within the vessel 38.

The horizontal rams 234 and 236 may be moved in opposite directions, that is with one being extended and one being retracted, to achieve rotational motion of vertical conduit 216 and manifold nozzle 210 about a vertical axis.

Horizontal rams 234 and 236 may be moved in the same direction, that is with both being extended or retracted at the same time, to achieve rotational motion of the vertical conduit 216 and the nozzle manifold 210 about a horizontal axis coincident with the center of the ball and socket joint 219.

Thus, the mechanical control system 218 provides a means for varying the vertical position of nozzle manifold 210 within vessel 38 and for rotating the nozzle manifold 210 about both vertical and horizontal axes.

Figure 21:
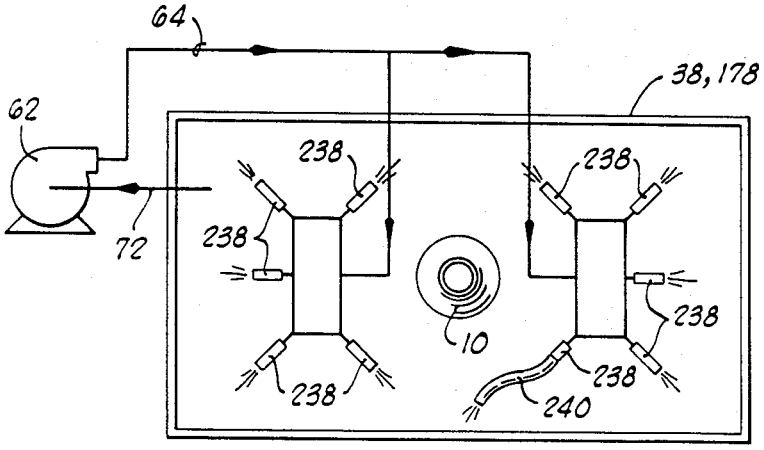
FIG. 21 is a plan schematic illustration of the fluid agitating apparatus of FIG. 1 in place within a rectangular vessel having two batteries of nozzles located in the interior of the vessel near the bottom of the vessel.

FIG. 21 shows yet another form of jet means designated by the numeral 238. Jet means 238 includes a plurality of nozzles 238 disposed in an interior portion of the vessel 38 near the bottom 80 thereof, and directed toward the wall portion 178 thereof. Flexible snake conduits such as 240 may be placed on any or all of the nozzles 238.

Vessels 38 having jet means such as 198, 202 or 238 are preferably used in situations where it may be necessary to provide extremely high mud weights on the order of eighteen to nineteen pounds per gallon, because in those situations sedimentation of the barite in the vessel 38 is a more severe problem than it is where lower mud weights are involved.

Thus, it is seen that the apparatus and methods of the present invention readily achieve the ends and advantages mentioned as well as those inherent therein. While certain preferred embodiments of the invention have been illustrated for the purposes of the present disclosure, numerous changes in the arrangement and construction of parts and steps may be made by those skilled in the art which changes are encompassed within the scope and spirit of the present invention as defined by the appended claims.

What is claimed is:

1. A fluid mixing system, comprising:

a vessel having a substantially vertical wall portion extending upward from a substantially horizontal bottom so that a vertical corner is defined in a vertical plane at an intersection of said wall portion and said bottom;

jet means, operably associated with said vessel, for inducing fluid flow adjacent said vertical corner and for thereby reducing deposition adjacent said vertical corner of sediment from a body of fluid contained in said vessel; and a fluid agitating means disposed in said vessel for agitating said body of fluid contained in said vessel, said fluid agitating means including:

a housing having an inlet disposed in a first end thereof, an open second end, and a flow passage disposed therethrough communicating said inlet and said open second end; and flow inducing nozzle means, attached to said housing, for jetting fluid into said flow passage and for thereby inducing flow fluid from said body of fluid contained in said vessel through said flow passage and out said open second end of said housing, and for imparting a swirling flow about a longitudinal axis of said housing to said fluid flowing through said flow passage.

2. The system of claim 1, wherein:

said jet means includes a plurality of nozzles disposed in said vessel adjacent said vertical corner and directed away from said wall portion of said vessel.

3. The system of claim 2, wherein:

said nozzles of said jet means extend through said wall portion of said vessel.

4. The system of claim 2, wherein:

said jet means further includes a second plurality of nozzles disposed in said vessel adjacent said vertical corner and directed toward said wall portion of said vessel.

5. The system of claim 1, wherein:

said jet means includes a plurality of nozzles disposed in said vessel adjacent said vertical corner and directed toward said wall portion of said vessel.

6. The system of claim 1, wherein:

said vessel is rectangular parallelepiped in shape such that said wall portion is defined by four adjoining flat rectangular wall sections and said bottom is rectangular in shape; and said jet means includes at least one nozzle located adjacent each horizontal corner of said bottom of said vessel and directed toward said wall portion of said vessel.

7. The system of claim 6, wherein:

said jet means further includes at least one additional nozzle located adjacent each horizontal corner of said bottom of said vessel and directed away from said wall portion of said vessel.

8. The system of claim 6, wherein:

said nozzles of said jet means are rotatable in orientation about a vertical axis.

9. The system of claim 1, wherein:

said vessel is rectangular parallelepiped in shape such that said wall portion is defined by four adjoining flat rectangular wall sections and said bottom is rectangular in shape; and said vessel further includes four corner cover means, one located at each intersection of two adjoining wall sections and said bottom, for preventing deposition of sediment at said intersections of two adjoining wall sections and said bottom.

10. The system of claim 1, further comprising:

pump means;

a suction conduit connected between said vessel and a suction inlet of said pump means; and a discharge conduit connected between a discharge outlet of said pump means and each of said jet means and said flow inducing nozzle means.

11. The system of claim 1, wherein:

said flow passage of said housing has a minimum cross-sectional area at a throat thereof and increases in cross-sectional area from said throat toward each of said first and second ends of said housing.

12. The system of claim 1, wherein:

said jet means includes a plurality of nozzles disposed in an interior portion of said vessel near said bottom and directed toward said wall portion of said vessel.

13. A method of agitating a body of fluid contained in a vessel having a substantially vertical wall portion extending upward from a substantially horizontal bottom portion, said method comprising the steps of:

withdrawing a stream of fluid from said body of fluid;

pressurizing said stream of fluid;

injecting a first portion of said pressurized stream of fluid into a flow passage of a fluid agitating apparatus submerged in said body of fluid; thereby inducing an upward swirling flow of said body of fluid through said flow passage, so that a lower portion of said body of fluid containing sediment is drawn upward into said flow passage and is mixed with said first portion of said stream of pressurized fluid and expelled with an upward swirling motion from said flow passage;

injecting a second portion of said pressurized stream of fluid into said body of fluid adjacent an intersection of said wall portion and said bottom portion of said vessel; and thereby inducing fluid flow adjacent said intersection and reducing deposition of sediment adjacent said intersection from said body of fluid.

* * * * *